US012055023B2

(12) United States Patent
Thompson et al.

(10) Patent No.: US 12,055,023 B2
(45) Date of Patent: Aug. 6, 2024

(54) APPARATUS, METHOD AND WELLBORE INSTALLATION TO MITIGATE HEAT DAMAGE TO WELL COMPONENTS DURING HIGH TEMPERATURE FLUID INJECTION

(71) Applicant: General Energy Recovery Inc., Calgary (CA)

(72) Inventors: Daniel Thompson, Calgary (CA); Brian Kay, Calgary (CA); Wes Sopko, Calgary (CA); Kevin Wiebe, Calgary (CA)

(73) Assignee: General Energy Recovery Inc., Calgary (CA)

( * ) Notice: Subject to any disclaimer, the term of this patent is extended or adjusted under 35 U.S.C. 154(b) by 30 days.

(21) Appl. No.: 17/606,537

(22) PCT Filed: Apr. 22, 2020

(86) PCT No.: PCT/CA2020/050526
§ 371 (c)(1),
(2) Date: Oct. 26, 2021

(87) PCT Pub. No.: WO2020/215150
PCT Pub. Date: Oct. 29, 2020

(65) Prior Publication Data

US 2022/0205348 A1 Jun. 30, 2022

(30) Foreign Application Priority Data

Apr. 26, 2019 (CA) ..... CA 3041700

(51) Int. Cl.
*E21B 36/00* (2006.01)
*E21B 33/12* (2006.01)
(Continued)

(52) U.S. Cl.
CPC ..... *E21B 43/162* (2013.01); *E21B 33/12* (2013.01); *E21B 33/124* (2013.01);
(Continued)

(58) Field of Classification Search
CPC ..... E21B 36/001; E21B 43/24; E21B 33/12
See application file for complete search history.

(56) References Cited

U.S. PATENT DOCUMENTS 3,357,490 A 12/1967 Holmes
3,456,734 A 7/1969 Dean et al.
(Continued)

OTHER PUBLICATIONS

European Patent Office, "Extended European Search Report", Dec. 5, 2022, pp. 1-7.
(Continued)

*Primary Examiner* — Catherine Loikith
(74) *Attorney, Agent, or Firm* — Kunzler Bean & Adamson

(57) ABSTRACT

Apparatus, method and wellbore installation to mitigate heat damage to well components during high temperature fluid injection operations such as steam injection from surface through a wellbore. The apparatus includes an injection tubing that conveys the high temperature fluid to an injection zone and an isolation packer through which a lower end of the injection tubing passes. A pipe extends alongside the injection tubing with an outlet end close above the packer. When the apparatus is installed in a wellbore, the pipe creates a cooling fluid circuit that flows from just above the packer up in the wellbore alongside the outer surface of the injection tubing to surface and then back into the pipe.

8 Claims, 5 Drawing Sheets

(51) Int. Cl.

| | |
|---|---|
| ***E21B 33/124*** | (2006.01) |
| ***E21B 43/14*** | (2006.01) |
| ***E21B 43/16*** | (2006.01) |
| ***E21B 43/24*** | (2006.01) |

(52) U.S. Cl.
CPC ..... *E21B 36/001* (2013.01); *E21B 43/14* (2013.01); *E21B 43/24* (2013.01)

(56) References Cited

U.S. PATENT DOCUMENTS

| | | | | |
|---|---|---|---|---|
| 3,498,381 | A | 3/1970 | Earlougher, Jr. | |
| 3,613,792 | A * | 10/1971 | Hyde ..... | E21B 33/10 166/57 |
| 3,662,832 | A | 5/1972 | Keeler et al. | |
| 9,243,478 | B2 * | 1/2016 | Du ..... | E21B 43/01 |
| 2008/0083536 | A1 | 4/2008 | Cavender et al. | |
| 2013/0192834 | A1 | 8/2013 | Schneider | |

OTHER PUBLICATIONS

PCT, "International Search Report", Jun. 18, 2020, pp. 1-3.
PCT, "Written Opinion of the International Searching Authority", ISR, Jun. 18, 2020, pp. 1-6.

* cited by examiner

APPARATUS, METHOD AND WELLBORE INSTALLATION TO MITIGATE HEAT DAMAGE TO WELL COMPONENTS DURING HIGH TEMPERATURE FLUID INJECTION

BACKGROUND OF THE INVENTION

Field of the Invention

Embodiments of the invention relate to solutions involving any high temperature fluid injection where there is a need to prevent high temperature effects to well components such as casing, sealing cement or the earthen formation, including the uphole shallow formation, through which the wellbore passes. A particular application is to mitigate adverse heat effects from steam injection.

Description of Related Art

There are extensive viscous hydrocarbon reservoirs throughout the world. The viscous hydrocarbon is often called "bitumen", "tar", "heavy oil", and "ultra heavy oil" (collectively called "heavy oil") which typically have viscosities in the range of 3,000 to over 1,000,000 centipoise. The high viscosity makes it difficult and expensive to recover the hydrocarbons.

Each oil reservoir is unique and responds differently to the variety of methods employed to recover the hydrocarbons therein. Generally, heating the heavy oil in situ to lower the viscosity has been employed. Normally these viscous heavy oil reservoirs can be produced with methods such as cyclic steam stimulation (CSS), steam drive (Drive) and steam assisted gravity drainage (SAGD), where steam is injected from surface into the reservoir to heat the oil and reduce its viscosity enough for production. The methods described above are commonly called Enhanced Oil Recovery (EOR) schemes.

A large number of heavy oil reservoirs were developed with well casing and sealing cement materials that cannot withstand temperatures typically used in steaming operations. Current "non-thermal" wellbore casing/cement systems are limited to temperatures between 60 and 120 deg C. (depending on the quality of the wellbore casing) without compromising the wellbore casing and sealing cement. Typical steam or high temperature injection EOR schemes operate at temperatures over 200 deg C.

Additionally, current methods of producing heavy oil reservoirs face other limitations. One particular problem is wellbore heat loss while the high temperature fluid or steam is traveling from surface to the reservoir. The problem worsens as depth increases and the steam quality decreases as more energy is lost to the wellbore and formations above the oil reservoir.

SUMMARY OF THE INVENTION

In accordance with a broad aspect of the present invention, there is provided a wellbore installation for a well comprising: a wellhead; an injection tubing extending along a length of the well and configured for conveying a high temperature fluid to an injection zone in the well, the injection tubing creating an annulus in the well between the injection tubing and a wall of the well; a packer set about the injection tubing and sealing the annulus; a pipe extending through the annulus alongside the injection tubing with an inlet end connected at the wellhead to surface piping and an outlet end positioned close to the packer; an outlet port on the wellhead; and a pump for creating a flow of a cooling fluid through a circuit from the surface piping through the pipe, from the pipe into the annulus close to the packer, returned up through the annulus alongside the injection tubing and out through the outlet port to the surface piping.

In accordance with another broad aspect of the present invention, there is provided a method for protecting a well from thermal damage during injection of high temperature fluids, the method comprising: a) introducing a cooling fluid to an annulus between a high temperature fluid injection pipe and the wellbore wall; b) allowing the cooling fluid to remain in the annulus for a residence time such that the cooling fluid becomes a heated cooling fluid; c) circulating the heated cooling fluid from the annulus; and repeating steps a-c.

In accordance with another broad aspect of the present invention, there is provided an apparatus for high temperature injection to a reservoir in a well, the apparatus comprising: an injection tubing couplable to a wellhead, the injection tubing configured for conveying a high temperature fluid to an injection zone in the well; a packer through which a lower end of the injection tubing passes; a pipe extending alongside the injection tubing with an inlet end configured for connection at the wellhead to surface piping and an outlet end positioned close to the packer; and an outlet port on the wellhead, the apparatus configured for creating a cooling fluid circuit that flows from surface through the pipe and from the pipe alongside an external surface of the injection tubing close to the packer and then returned up to surface alongside the injection tubing and out through the outlet port.

It is to be understood that other aspects of the present invention will become readily apparent to those skilled in the art from the following detailed description, wherein various embodiments of the invention are shown and described by way of example. As will be realized, the invention is capable for other and different embodiments and several details of its design and implementation are capable of modification in various other respects, all captured by the present claims. Accordingly, the detailed description and examples are to be regarded as illustrative in nature and not as restrictive.

BRIEF DESCRIPTION OF THE DRAWINGS

It is noted that the attached drawings illustrate only typical embodiments of this invention and are therefore not to be considered limiting in scope, for the invention may admit to other equally effective embodiments.

DETAILED DESCRIPTION

Figure 1:
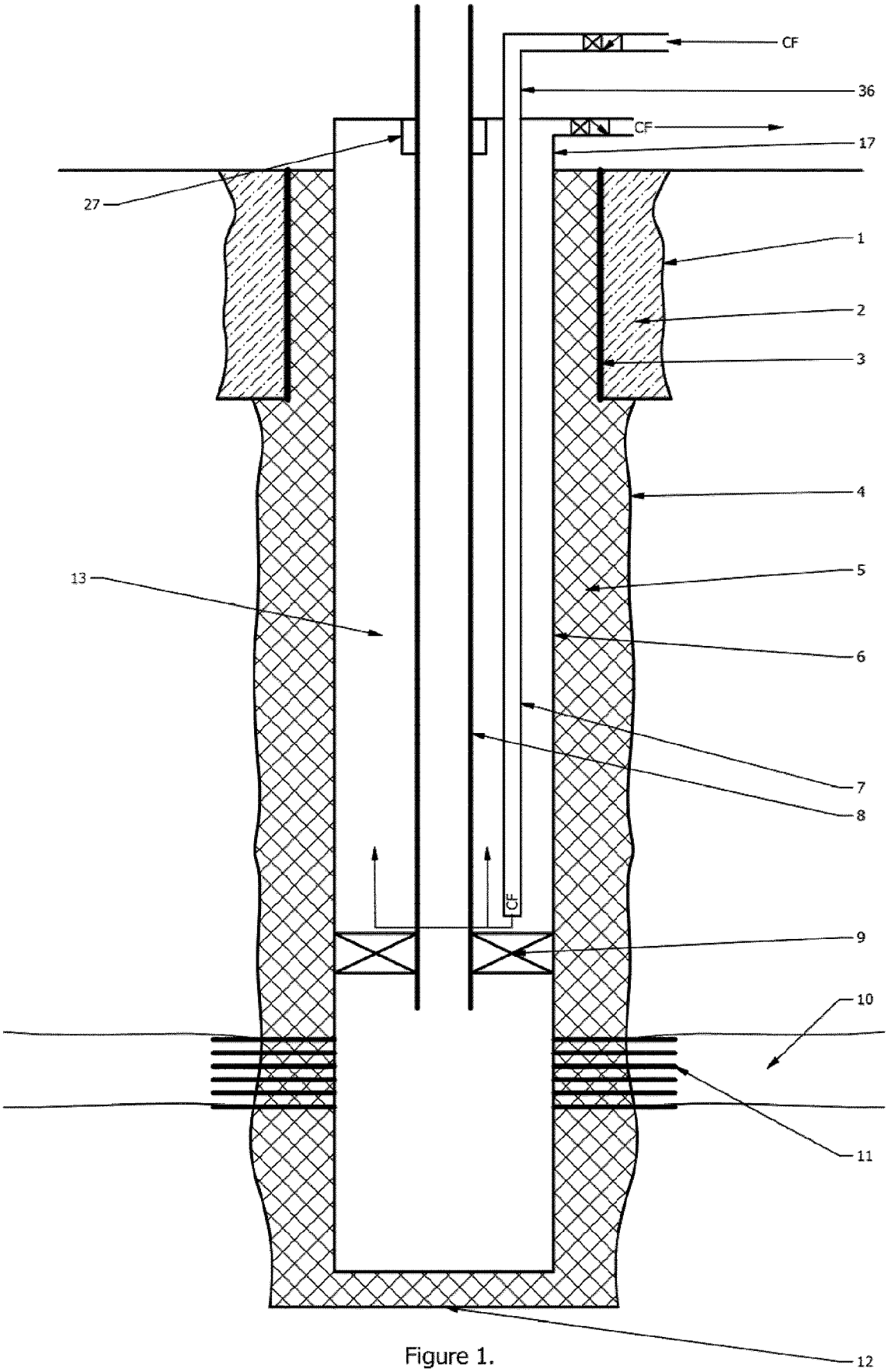
FIG. 1 illustrates a side view of a typical wellbore completed with "non-thermal" wellbore piping and sealing cement.

Embodiments of the invention generally relate to an apparatus, a wellbore installation and a method related to a cooling fluid circuit to counteract any heat-generated damage to the well components during high temperature injection. For example, embodiments of the invention protect well components such as the wellhead, shallow formations, wellbore casing and/or wellbore cement from the effects of high temperature injection.

While high temperature injection is often used in the recovery of heavy oil, it is to be noted that aspects of the invention are not limited to use in the recovery of heavy oil but are applicable to recovery of other products such as gas hydrates.

The apparatus includes an injection tubing that conveys the high temperature fluid to an injection zone. The injection tubing may be insulated to reduce heat transfer through the tubing walls. The apparatus further includes an isolation packer above the injection zone with the packer type to be compatible with high temperature and corrosive fluid injection. The packer can be any of mechanical set, hydraulic set, swellable, inflatable and slipless depending on well type, depth and application. The injection tubing passes through the packer, but the packer seals the annulus between the injection tubing and the wellbore casing that defines the interior wall of the wellbore. A second pipe that has a diameter sized to fit in the annulus between the injection tubing and the wellbore casing is also employed in the installation. The second pipe may have a diameter substantially equal to or smaller than the injection tubing. The second pipe is installed to extend from surface into the annulus. For example, in one embodiment the second pipe has its outlet end positioned close above the packer. It does not pass through the packer like the injection tubing, but instead the second pipe opens on the side of the packer opposite the injection zone side. Having the outlet end immediately uphole of the packer allows the system to operate most efficiently by providing cooling to the entire wellbore length. Further, the full inner diameter can be used to circulate the cooling fluid out of the wellbore.

This second pipe could be continuous or jointed such as any of coil tubing (continuous steel and/or polymeric pipe) or jointed steel or polymeric pipe. Polymeric pipe can be any of various high temperature plastic materials such as of polyvinylchloride (PVC). In the case of jointed steel pipe or high temperature plastic pipe, such material can be coupled to the injection tubing to improve its stability and facilitate installation. Continuous steel pipe such as coil tubing can be installed without coupling to the injection tubing. The surface termination of the second pipe allows installation and removal of continuous steel pipe without removal of the injection piping. In particular, second pipe in the form of continuous steel pipe, can be installed and removed through the wellhead apart from removal of the injection tubing. Other types of second pipe are installed and removed while installing or removing the injection tubing. The surface connection (wellhead) has an outlet from the annulus. The outlet from the wellhead is close to the safety seal and therefore the wellhead is configured to reduce heat damage as close to surface and the wellheard as possible.

The wellbore installation permits a high temperature fluid to be conveyed from surface, through the well and into the wellbore, and the oil reservoir accessed therethrough, below the packer. At the same time, heat damage to the surrounding wellbore wall components (i.e. casing and cement) and the shallower formations is mitigated through the possible use of insulated injection tubing and a cooling fluid circuit through the second pipe. In particular, a cooling fluid can be introduced to the annulus above the isolation packer through the second pipe and after a residence time the cooling fluid is evacuated at the wellhead. Thus, a circulation of cooling fluid may be established through the wellbore annulus. The cooling fluid circuit mitigates heat damage to well components and shallow formations during high temperature fluid injection operations.

The wellbore installation works with surface process equipment including equipment for handling cooling fluid. Equipment may include, for example, fluid storage, a pump, a heat exchanger for cooling the cooling fluid, operating and safety controls and piping to provide a continuous cooling fluid flow into the well annulus between the injection tubing and the wellbore casing. The control system design and wellhead seals are provided to allow safe operation of the fluid flow and to prevent injected fluids from escaping to surface. This continuous fluid flow will provide temperature control to the wellbore casing and cement. Surface piping could be a closed circuit or open circuit depending on the amount of temperature control required to protect the wellbore casing. If the temperature of the cooling fluid coming to surface can be cooled reasonably, then the fluid will be cooled and circulated back into the well. However, if the temperature is too high, then it may be uneconomical to recycle it.

Embodiments of the invention relate to surface wellhead/wellbore/well casing/formation protection from high temperature injection operations. One embodiment of the invention relates to steam injection into "non-thermal" wellbores where wellbore casing and sealing cementing cannot withstand the high temperatures of steam injection or other high temperature injection EOR schemes. In another embodiment, the invention relates to steam injection into "thermal" wellbores where well piping and sealing cementing were selected to withstand the high temperatures of steam injection but where there is a desire to reduce or eliminate wellbore casing growth above the injection zone. Apparatus according to the invention includes a packer on thermally insulated injection tubing (IT), such as for example vacuum insulated injection tubing (VIT), installed to immediately above the oil reservoir with a second pipe installed between the IT and the wellbore casing from surface to the top of the packer. At surface the apparatus includes wellhead connections and equipment for handling the cooling fluid such as any of piping, closed or open fluid storage tanks, a pump and operating and safety controls whereby a cooling fluid is pumped, for example possibly continuously, into the annulus between the wellbore casing and the injection tubing to remove from the well any heat being lost by the IT. If desired, a heat exchanger cools the cooling fluid returned from the wellbore. This cooling fluid could be cooled by heat exchange, for example possibly to transfer its heat into the fluid to be used in the generation of the steam or high temperature fluid, or by other conventional cooling methods such as air coolers.

In one embodiment of the invention, the operation system can include an aspect of temperature control. In one embodiment of the invention, the safety control system can be operated on vessel pressure. In another embodiment of the invention, the safety control system can be operated on fluid flow. While the cooling system protects the well from thermal expansion causing damage, these operation and safety control systems can further be employed to monitor overall well operations, packer condition and for well control.

The cooling fluid can be any fluid capable of storing and transferring heat such as, for example, one or a combination of water, hydrocarbon, cooling fluid/refrigerant, air or nitrogen. Embodiments of the invention can relate to processes where the cooling system is used to prevent heat loss from drilling or production operations in permafrost areas. In this embodiment the system would use an environmentally friendly cooling fluid, for example a hydrocarbon such as glycol, which can remain fluid below 0 deg C.

With reference now to the drawings, FIG. 1 illustrates a typical "non-thermal" well. Drilled hole 1 contains surface casing 3 which has been cemented with non-thermal cement 2. Drilled hole 4 contains non-thermal production casing 6 which has been cemented with non-thermal cement 5. Injection tubing (IT) 8 is connected at surface to the injection wellhead 17. Injection tubing 8 extends down through an isolation packer 9 immediately above the heavy oil reservoir 10. Steam or other high temperature fluid is injected from surface, down and out through the lower end of IT 8, through production casing perforations 11 and into heavy oil reservoir 10. Total depth of the well is illustrated by 12. Cooling fluid CF is injected from a supply through line 36 at surface through second pipe 7. Cooling fluid CF is introduced to an annulus 13 between the IT 8 and casing 6 at the outlet end 7' of the pipe adjacent packer 9 and is returned to surface through annulus 13 where it is evacuated at wellhead outlet 29. Outlet 29 is close to the upper end of the annulus, directly below the wellhead annular safety seals 27. The cooling fluid at outlet 29 has been heated by heat radiating from injection tubing 8. The cooling fluid circuit protects wellhead 17, the non-thermal well casing 6 and non-thermal cement 5 from thermal damage. To additionally reduce heat loss to the wellbore, IT 8 can be configured with a thermally insulated wall. There may be check valves in lines 29 and 36 to ensure the direction of flow.

Figure 2:
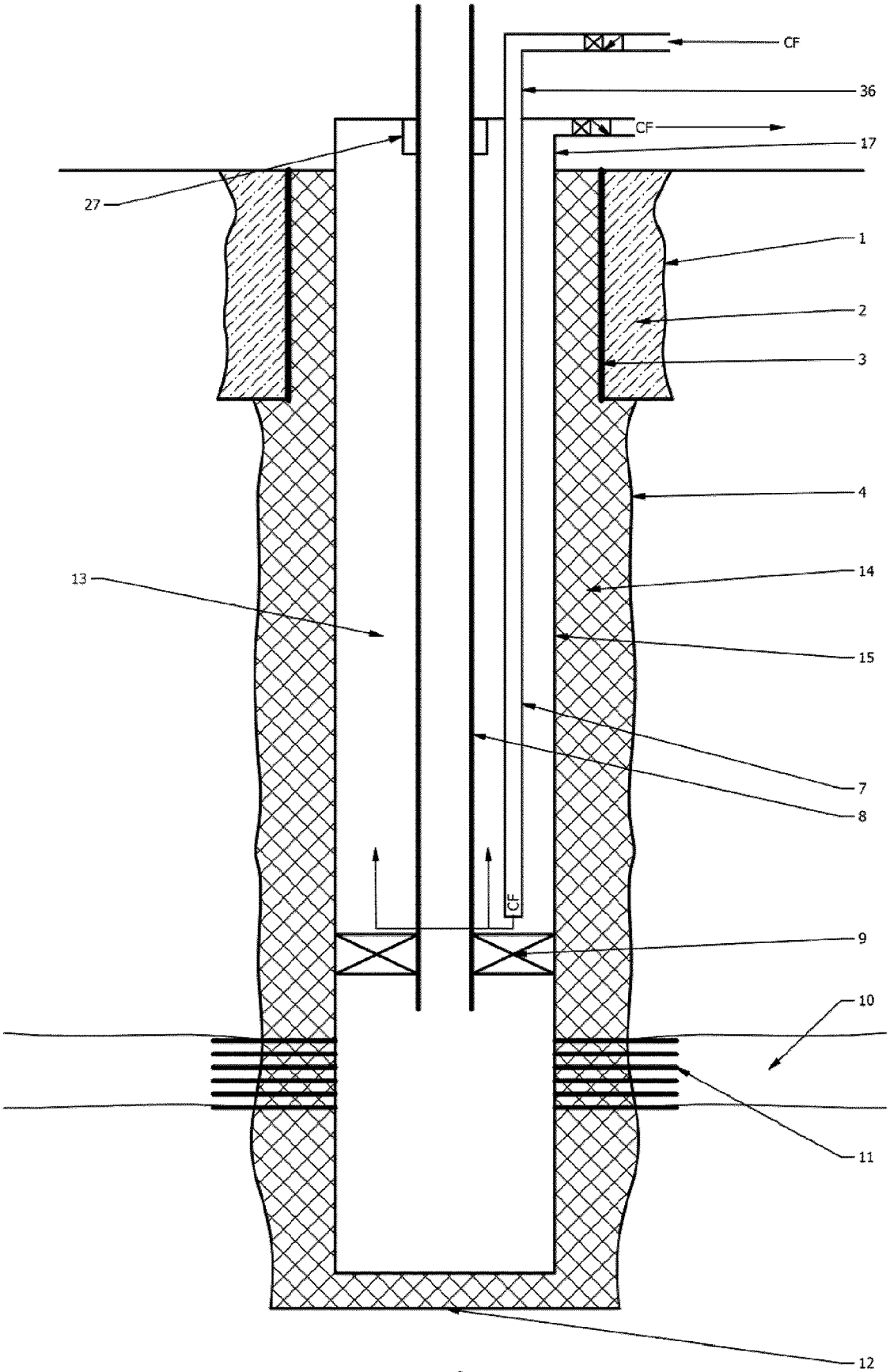
FIG. 2 illustrates a side view of a typical wellbore completed with "thermal" wellbore piping and sealing cement.

FIG. 2 illustrates a typical "thermal" well. Items 1, 2 and 3 are as above, drilled hole 4 contains thermal production casing 15 which has been cemented with thermal cement 14. Items 7, 8, 9, 10, 11 and 12 are as above. Cooling fluid CF, to prevent thermal growth of thermal production casing 15, is again injected through second pipe 7 and returned to surface through annulus 13 and wellhead outlet 29.

Figure 3:
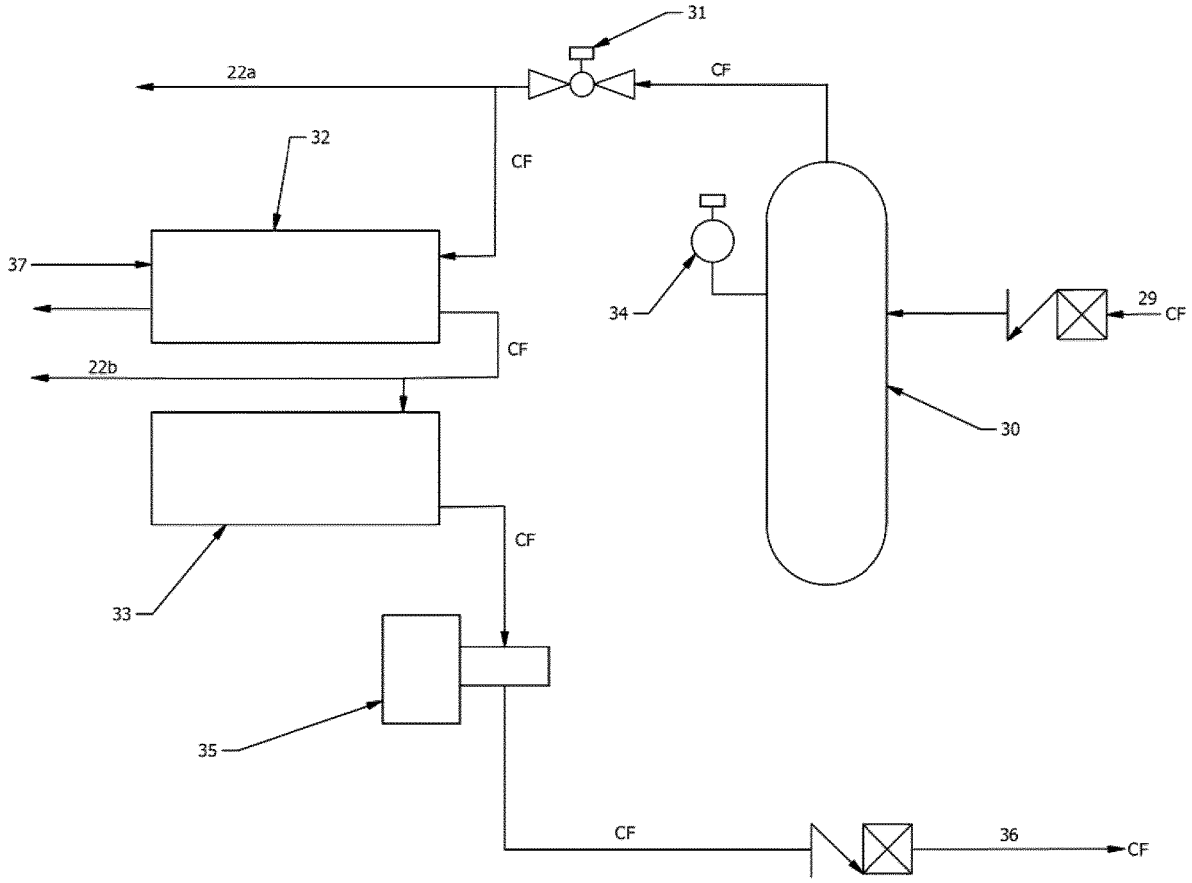
FIG. 3 illustrates a Pipe and Instrumentation Diagram (P&ID) of the surface apparatus including vessels, fluid storage, pump, heat exchanger, piping, safety and operating controls for a pressure safety control embodiment.

FIG. 3 illustrates one embodiment of surface equipment. In any system, the wellbore-heated, returning cooling fluid CF flows from outlet 29 and may be disposed of for example through piping 22*a*. However, in many embodiments, the thermal energy therein may be recovered and/or the fluid may be recycled. For example as shown, cooling fluid returning from the well in line 29 may be directed to a cooler 32 for fluid cooling therein. The fluid may then be sent to other processes or disposal 22*b*, pumped to a storage tank 33 or returned to the well through piping 36 either directly or from tank 33. A pump 35 drives the circulation of the cooling fluid. For example, pump 35 operates to draw cooling fluid CF from tank 33 and to circulate it back down the second pipe 7 (FIGS. 1 and 2) before the cooling fluid returns up annulus 13 to return fluid piping 29.

The cooling fluid that is heated by circulation through the well may be cooled by use of a cooler. In this embodiment, cooler 32 is a heat exchanger that transfers heat energy to either cold process fluid 37 or air. In one embodiment, the process fluid is used for production of steam and, therefore, the heat exchanged in heat exchanger 32 beneficially preheats the process fluid.

In this embodiment, the surface piping and instrumentation may be useful for a pressure monitored cooling method with a safety shut down mode. Thus, the surface equipment in this embodiment further includes an emergency shut down (ESD) valve 31 and a pressure controller 34. The surface equipment pumps the returned, heated cooling fluid CF into communication with pressure controller 34, then through emergency shut down (ESD) valve 31 before reaching heat exchanger 32.

Pressure controller 34 is upstream of ESD 31 and will close the ESD 31 if a predetermined overpressure condition is sensed. For example, injection pressure, through string 8 and below packer 9 is higher than hydrostatic pressure in annulus 13. Thus, if string 8 or the isolation packer leaks and therefore fails, the pressure from the injection fluid may create a problematic increase in pressure which may come up through the annulus to surface. The present cooling circuit can monitor continuously, identify a string or packer failure and actuate ESD 31 to control the well. Pressure controller 34 can also communicate the sensed over pressure condition to the injection controls to possibly also cause the shut down of the injection system.

The piping up to ESD 31 is high pressure pipe. However, because of the well control afforded by ESD 31, the pipe and equipment thereafter need not have high pressure ratings to thereby provide cost efficiencies.

The surface equipment in this and other embodiments may further include a pressure vessel 30 close to the wellhead, which is useful as a volume buffer in case of an overpressure condition. Vessel 30 may be upstream of the ESD to permit a volume of return fluid to be accommodated even before the ESD.

Figure 4:
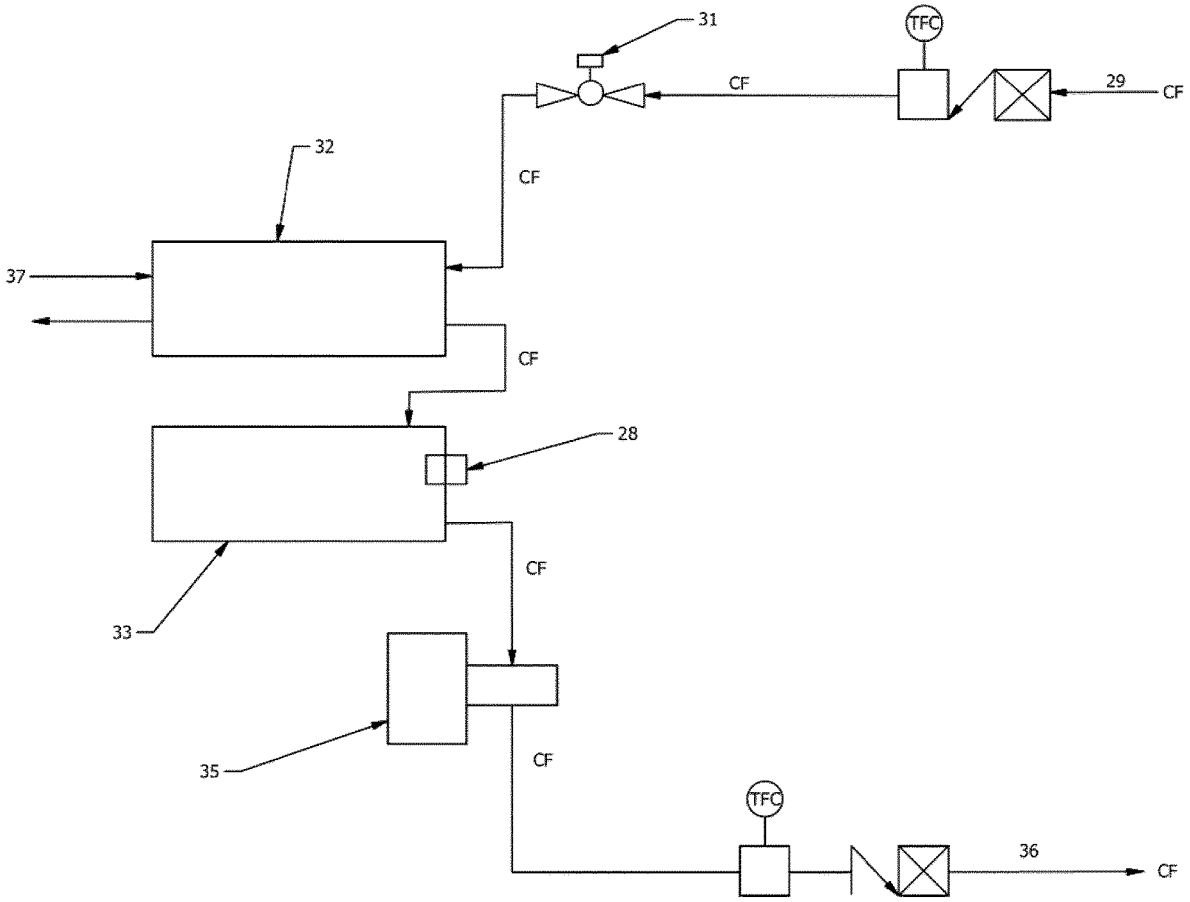
FIG. 4 illustrates a P&ID of the surface apparatus including fluid storage, pump, heat exchanger, safety and operating controls for a flow safety control embodiment.

FIG. 4 illustrates another embodiment of surface control piping and instrumentation. This embodiment is useful in a flow monitored cooling method, which includes one or more flow volume monitors. Failures such as packer, string or casing failures can lead to cooling fluid volume increases or decreases. For example, if packer 9 fails, fluid can be lost to or gained from the injection zone depending on the pressure condition of the injection zone. Any variance in the cooling fluid volume can be identified by a fluid volume meter such as a fluid level gauge 28 in tank 33 or via a flow meter (TFC) 38 in the piping.

The piping in a closed circuit is configured such that wellbore heated return fluid from outlet 29 flows through and then through emergency shut down (ESD) valve 31 before optionally passing to heat exchanger 32 and tank 33. Heated fluid is cooled, herein via a heat exchanger 32 by either cold process fluid 37 or by other means such as air. Cooling fluid CF is drawn from tank 33 by pump 35 which circulates it back down the second pipe 7 (FIGS. 1 and 2) before returning up annulus 13 to return fluid 29 piping.

Volume meters 28 and/or 38 will close ESD 31 if flow volumes vary outside of an acceptable range. Flow meter 38, for example, monitors for return flows greater or less than the output of pump 35 or in comparison to another flow meter (TFC) on the introduction line 36. While volumes returning that are less than those introduced may be accommodated, an increase in volume is cause for immediate shut down as noted above with respect to FIG. 3. While tank gauge 28 is good for a closed loop system, flow meter 38 is useful for both a closed and an open system.

Figure 5:
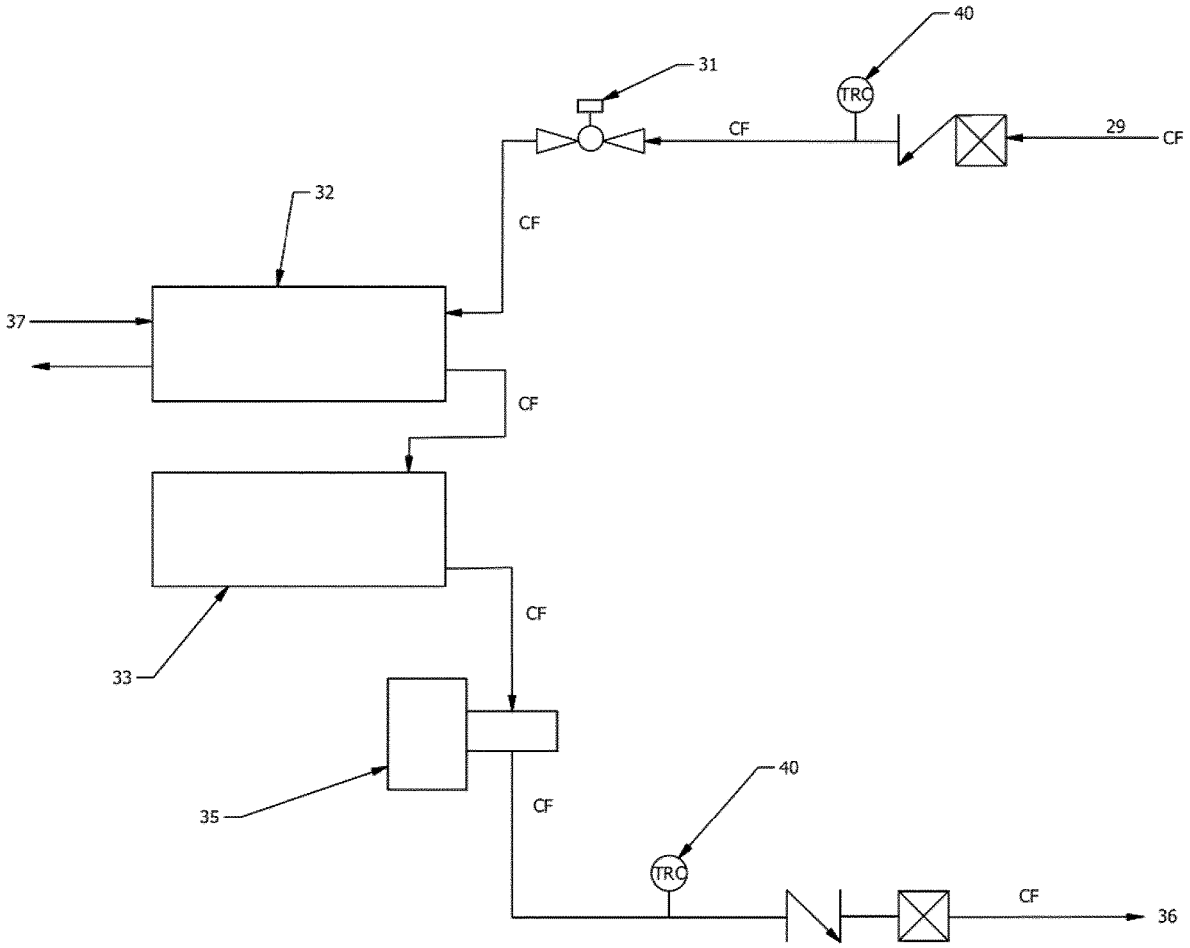
FIG. 5 illustrates a P&ID of the surface apparatus including fluid storage, pump, heat exchanger, safety and operating controls for a temperature safety control embodiment.

FIG. 5 illustrates another embodiment of surface control piping and instrumentation. This embodiment is useful in a temperature monitored cooling method, which includes one or more temperature sensors (TRC) 40. A system that monitors temperature gain in fluid returning from the well may be useful to monitor the system efficiencies. If the temperature sensor identifies a return temperature in excess of a predetermined limit, it may indicate that the IT 8 is failing, for example, losing its thermal insulative properties. The system could be altered to increase cooling or flow rate of the cooling liquid or IT 8 could be replaced. Temperatures of cooling fluid entering through line 36 and pipe 7 will be generally less than 20 deg C., while returning temperatures should be maintained at less than 70 and possibly less than 60 deg C.

The systems of FIGS. 3-5 can be used in various combinations.

The previous description and examples are to enable the person of skill to better understand the invention. The invention is not be limited by the description and examples but instead given a broad interpretation based on the claims to follow.

The invention claimed is:

1. A method for protecting a well from thermal damage during injection of high temperature fluids, the method comprising:

a) introducing a cooling fluid to an annulus between a high temperature fluid injection pipe and the a wellbore wall and above an isolating packer uphole of a reservoir receiving an injection of high temperature fluids from the high temperature fluid injection pipe;

b) allowing the cooling fluid to remain in the annulus for a residence time such that the cooling fluid becomes a heated cooling fluid;

c) circulating the heated cooling fluid from the annulus; and d) repeating steps a-c;

e) monitoring a pressure of the heated cooling fluid;

f) monitoring flow including monitoring a return flow of the heated cooling fluid in comparison to an inflow of the cooling fluid into the well; and g) altering the method and identifying a packer failure if at least one of:

the pressure exceeds a preselected level, and the return flow varies from the inflow.

2. The method of claim 1 further comprising cooling the cooling fluid after circulating the heated cooling fluid from the annulus.

3. The method of claim 2 wherein cooling transfers heat energy from the heated cooling fluid to process fluid used for injection.

4. The method of claim 1 wherein introducing includes pumping the cooling fluid through an outlet at a depth in the well.

5. The method of claim 4, wherein the outlet is immediately uphole of the packer.

6. The method of claim 1, wherein repeating steps a-c is by a continuous circulation of the cooling fluid from surface and up through the annulus back to surface, and the method further comprises cooling the cooling fluid before introducing.

7. The method of claim 1 wherein the method mitigates thermal expansion of thermal well casing from injection of steam or high temperature fluids.

8. The method of claim 1, wherein altering includes shutting down at least some of steps a-c.

* * * * *